United States Patent [19]

Corbett

[11] 4,252,229

[45] Feb. 24, 1981

[54] WALKING BEAM TREATMENT APPARATUS WITH ROTATABLE WORKPIECE CONTAINING BARRELS

[75] Inventor: Sidney C. Corbett, Birmingham, England

[73] Assignee: Hoklykem Holdings Limited, Great Britain

[21] Appl. No.: 26,361

[22] Filed: Apr. 2, 1979

[30] Foreign Application Priority Data

Mar. 1, 1979 [GB] United Kingdom ..... 07268/79

[51] Int. Cl.[3] ..... B65G 49/04

[52] U.S. Cl. ..... 198/342; 118/418; 118/425; 134/76; 134/159; 134/160; 366/220; 414/222; 414/750

[58] Field of Search ..... 414/750, 754, 222; 198/342, 344, 375, 377, 378, 473, 680; 118/417, 418, 425; 134/76, 77, 157, 159, 160, 165; 366/213, 220

[56] References Cited

U.S. PATENT DOCUMENTS

| | | | |
|---|---|---|---|
| 2,903,994 | 9/1959 | Hrubec | 118/425 X |
| 3,022,881 | 2/1962 | Harper et al. | 198/342 |
| 3,121,646 | 2/1964 | Smart | 198/342 X |
| 3,152,425 | 10/1964 | Katz et al. | 134/157 X |
| 3,559,553 | 2/1971 | Buechner | 118/425 X |
| 3,910,297 | 10/1975 | Pinkham | 134/160 X |

FOREIGN PATENT DOCUMENTS

| | | | |
|---|---|---|---|
| 1409784 | 10/1975 | United Kingdom | 198/342 |

*Primary Examiner*—L. J. Paperner
*Attorney, Agent, or Firm*—Klarquist, Sparkman, Campbell, Leigh, Hall & Whinston

[57] ABSTRACT

A treatment apparatus using a walking beam transporter is provided with an indexing mechanism for enabling barrels supported on the beam to be indexed rotationally in use, either in a treatment solution or when raised above it. The drive mechanism comprises a rod extending along the transporter beam and supported in low friction bearings for linear reciprocated movement. The rod is driven by a piston and cylinder assembly housed inside the beam, via a pendulum link. Each barrel is provided with a ratchet and pawl mechanism operated from the rod via a lever link on the barrel mounting.

8 Claims, 6 Drawing Figures

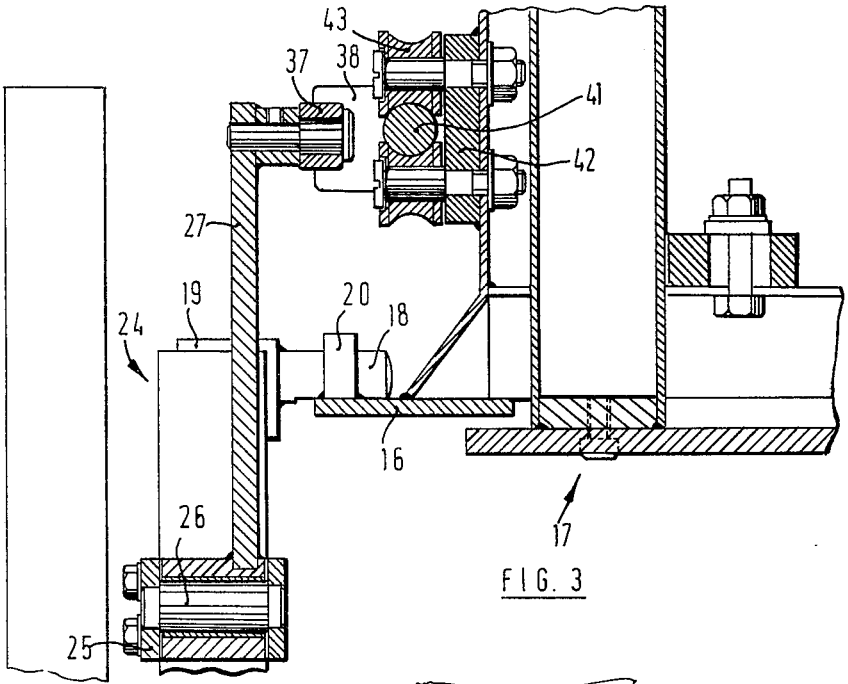
FIG. 3
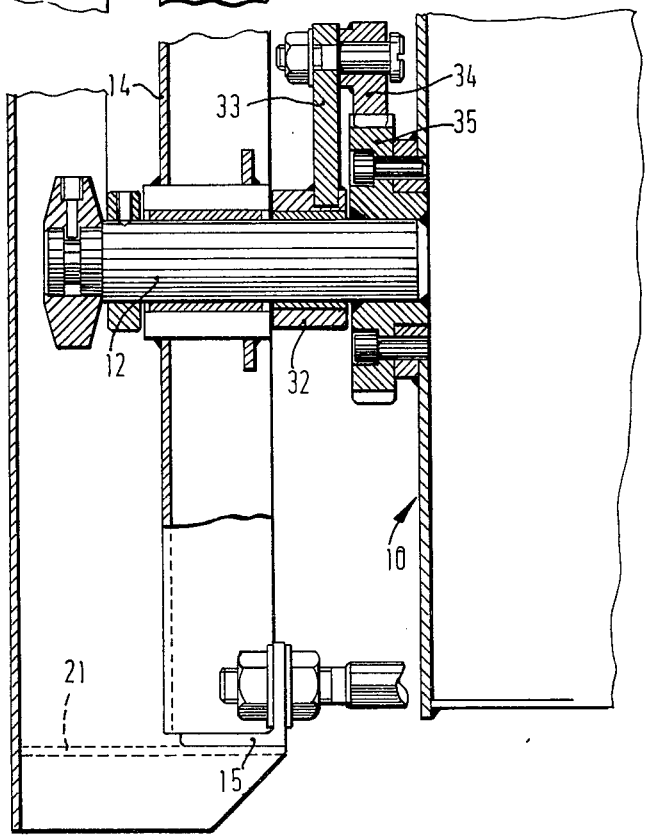

WALKING BEAM TREATMENT APPARATUS WITH ROTATABLE WORKPIECE CONTAINING BARRELS

BACKGROUND OF THE INVENTION

1. Field of the Invention

This invention relates to a treatment apparatus for workpieces in which a plurality of treatment stations are provided disposed side by side along the apparatus, and transporter means are provided to transport workpieces from one treatment station to the next along the apparatus. Such treatment apparatus may be used for cleaning, pickling, plating and similar treatments applied to workpieces. Usually, each treatment station will comprise a tank of a liquid into which the workpieces are immersed for treatment but there may be treatment stations where articles are sprayed with a liquid or treated with a gas, for example warm air for drying purposes. The particular details of the process being carried out are not relevant to the present invention.

Many different types of workpiece may need to be treated and the workpieces are commonly supported either on jigs or in open topped baskets or in fully enclosed barrels made of a perforated material to allow access of the treatment medium to the articles. The present invention was devised for a treatment machine in which at least some of the articles to be treated are enclosed in barrels.

2. Description of the Prior Art

It is essential, when workpieces are enclosed in a barrel, to ensure that the treatment medium penetrates fully through the perforated barrel and flows freely around the workpieces. Treatment apparatus has been proposed in which each barrel is provided with an external toothed gear wheel which can engage a drive gear at each of the stations, the individual drive gears being driven by respective electric motors. The barrel is rotated by the motor so that the workpieces inside are tumbled through the treatment medium which percolates into the barrel.

However, this rotation arrangement is of limited applicability since the axis of the barrel needs to be stationary so as to engage the drive gear. The barrel can only be rotated at the treatment station when it is in the treatment medium. Where cup-shaped articles are being treated or the barrel contains a large number of very small articles, quite large quantities of the treatment medium may be lifted out of the tank at the treatment station when the articles are removed from the treatment medium. It would be desirable to be able to rotate the barrel just above the surface of the treatment medium for drainage purposes but this has not been possible with the fixed drive motor and spur-gear arrangement referred to.

There are various different types of treatment apparatus and the invention was devised especially for use with a walking beam type of treatment apparatus, as described in our prior British Pat. No. 1,409,784, for example.

When a walking beam type transporter is used, it has hitherto not proved possible to arrange for rotation of the barrel either in or above the treatment medium.

The type of apparatus referred to as a "walking beam" type of treatment apparatus has a long rigid horizontal beam which can be raised and lowered and also moved longitudinally of the apparatus, for example by means of a suitable arrangement of chains and pulleys with hydraulically or pneumatically operated drive means. The barrels (or jigs or baskets) are suspended from the beam by means of parts which rest on supporting ledges of the beam. This enables the beam to pick up the workpieces, move them longitudinally from one station to another, lower them at the treatment stations into the relevant medium and then disengage from the barrel by slight further downward movement so that the beam can be returned to its original longitudinal position to pick up the next adjacent set of workpieces.

In addition to this movement, the beam can be arranged to perform a reciprocating up and down movement whilst supporting the workpieces at the treatment stations so as to "dunk" the workpieces in the treatment medium to ensure good coverage of the workpieces by the medium. This dunking may be especially useful where the workpieces are provided in an open topped basket. The articles may be packed together and prevent access of the treatment medium but the basket can only satisfactorily be agitated in an up and down "dunking" movement without the risk of losing some of the workpieces.

However, if a walking beam type of machine is to be capable of use to treat articles in barrels as well as in baskets or jigs, it would be desirable to be able to rotate the barrels without interfering with the normal functioning of the machine and in particular to do so independently of the position of the beam so that rotation is independent of dunking and can be carried out whether the barrel is immersed at, or disposed above the treatment station.

BRIEF SUMMARY OF THE INVENTION

It is an object of the present invention to provide a walking beam type treatment apparatus wherein a barrel containing workpieces can be rotated at least at one treatment station.

Some or all of the problems and disadvantages referred to above may be overcome by embodiments of the invention.

According to the invention there is provided a walking beam type treatment apparatus comprising a plurality of side by side treatment stations, one or more barrels adapted to contain workpieces, a transporter beam adapted to support the barrel or barrels and capable of movement longitudinally of the apparatus to transport workpieces from one station to another, and of up and down movement to raise and lower the workpieces at the treatment station, the or each barrel being rotatably mounted and being provided with an indexing mechanism including a pivoted lever linkage, and the beam having a longitudinally reciprocable barrel drive means adapted to bear on said lever linkage to operate the indexing mechanism when the barrel is supported by the beam.

The barrel may be released from the beam by providing supports at the treatment station on to which it may be lowered, the beam being arranged to then move downwardly by a short distance to free itself from the barrel to enable a return movement of the beam to take place to its original position.

The reciprocable barrel drive means may comprise a rod supported for movement along the beam and provided, at one or more treatment stations, with at least one outwardly extending lug adapted to bear on the lever linkage when the barrel is supported on the beam.

Preferably, two such lugs are provided, spaced apart from each other sufficiently to receive the lever linkage between the lugs, whereby the lugs alternately engage the lever linkage during reciprocating movement in alternate directions of the rod.

The indexing mechanism may comprise a ratchet wheel secured rigidly to the barrel and capable of being indexed in one direction of rotation by the lever linkage, pawl means being provided to hold the ratchet wheel against rearward movement after each forward indexing movement of the ratchet wheel.

The reciprocable barrel drive means may be reciprocated by a piston and cylinder assembly. Preferably, where the barrel drive means comprises a reciprocable rod of substantial length, the piston and cylinder assembly is mounted on the beam at a position where it will not be fouled by the movement of the beam or the barrels during use and is operatively connection to the rod by a linkage comprising a swinging arm caused to undergo arcuate movement by reciprocating movement of the piston, the arm being linked to the rod by coupling means capable of transmitting only a linear component of the swinging movement of the arm. These means may comprise a bush mounted for horizontal sliding movement parallel with the rod and having a portion of the swinging arm slidably received therein, the slidable movement of the swinging arm relative to the block being in a direction perpendicular to the direction in which the block itself reciprocates.

The invention will now be described in more detail by way of example only with reference to the accompanying drawings in which:

BRIEF DESCRIPTION OF THE DRAWINGS

FIG. 3 is an axial sectional view of the barrel of FIG. 1 in use in a walking beam type of treatment apparatus

DETAILED DESCRIPTION

Figure 1:
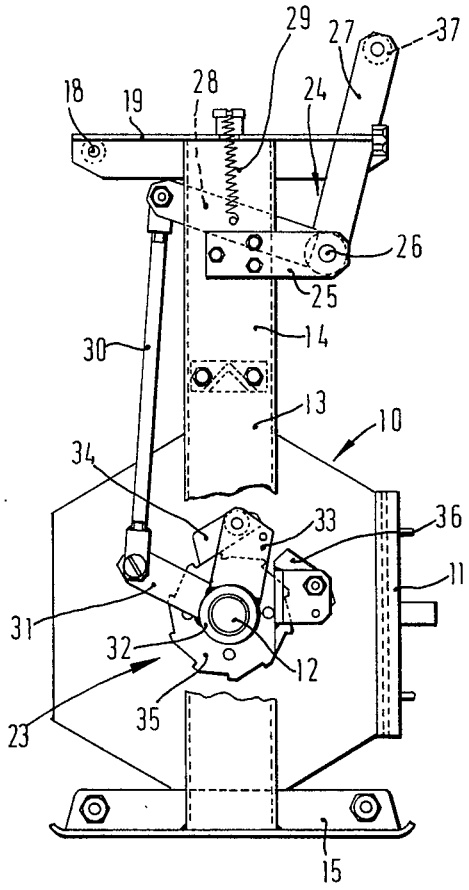
FIG. 1 is a side elevation, partly broken away, of a barrel, shown to a small scale.

Referring firstly to FIG. 1 of the drawings, a barrel is generally indicated at 10 and is of constant hexagonal cross-section, having one wall provided with a closure 11 through which articles for treatment are inserted and from which they are withdrawn at the end of the treatment cycle. The barrel is mounted for rotation about an axis 12, the ends of which are journalled in a frame 13 which is shown partly broken away for clarity. The frame comprises a pair of limbs 14 which receive the opposed ends of the axis. Each limb has, at its lower end, a rigid transverse foot 15. The upper ends of the limbs are provided with means for resting on a flange of a main transporter beam of the apparatus, this arrangement being seen more clearly in FIG. 3 of the drawings and also being illustrated somewhat diagrammatically in FIG. 2. A flange 16 of the main transporter beam generally indicated at 17 supports a pair of pegs 18 welded to respective angle bracket 19 which in turn is welded to the top of each limb 14. Two pegs are provided at opposed ends of the angle bracket at each end of the barrel and a pair of stops 20 are welded to the flange 16 of the main beam at each treatment station. The barrel is therefore supported by four pegs 18, located by four stops 20, two at each end of the barrel.

Figure 6:
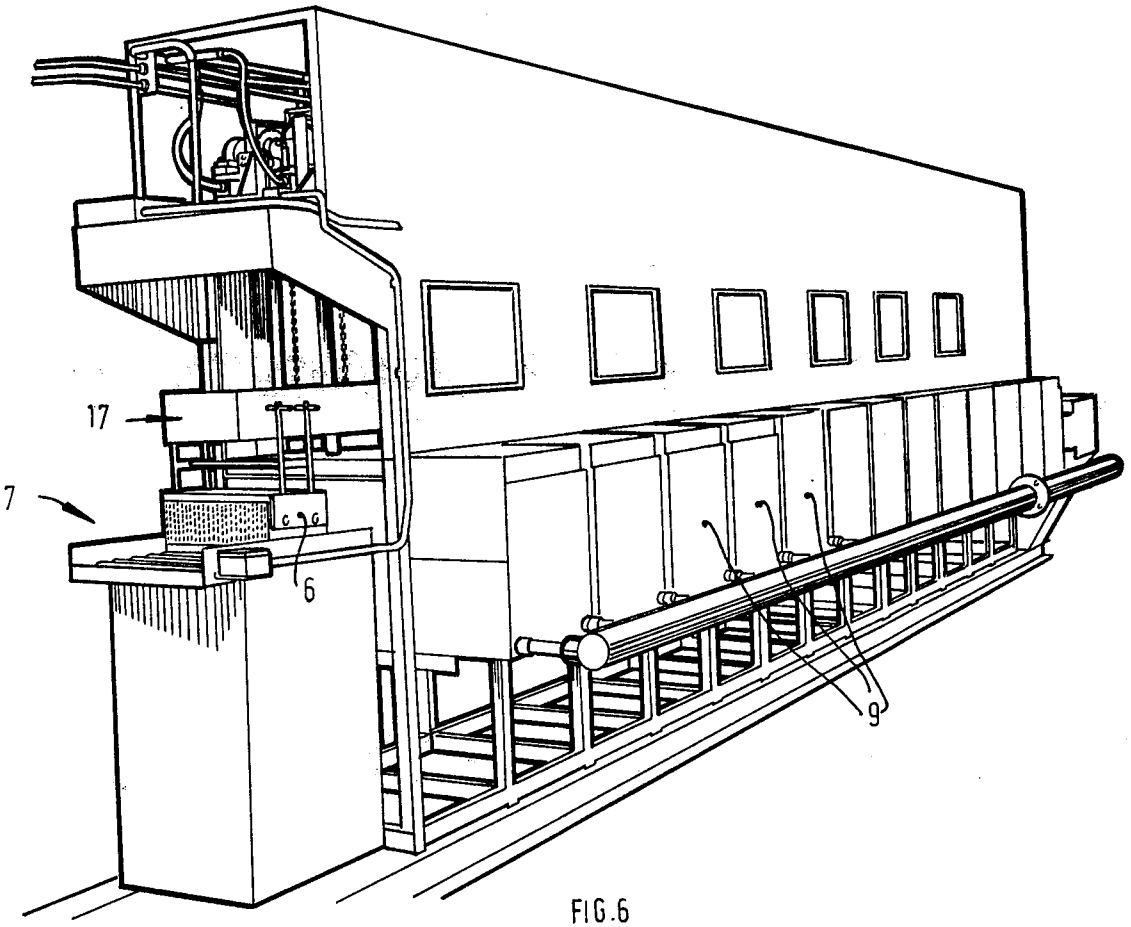
FIG. 6 is a perspective view of the treatment apparatus.

The treatment apparatus overall is of generally conventional design as shown in FIG. 6. It comprises a row of treatment stations 9 disposed side by side, together with a main transporter beam 17 mounted for up and down movement and also for longitudinal movement relative to the stations. Each treatment station is provided with suitable guides and also with a support bracket 21 which can support a load to be treated. The main transporter walking beam 17 picks up a load at a first loading station, raises it, moves longitudinally of the apparatus until the load is directly above the first treatment station, lowers the load until it reaches and is supported by the support brackets 21 at the treatment station and then continues moving downwardly to release the load temporariliy. The beam then moves longitudinally in the reverse direction so as to return towards the loading station. It will be appreciated that repeated movements of the beam will tend to work the load along the apparatus to the discharge end, generally indicated at 7 and that a series of loads can therefore be treated simultaneously, each load occupying an adjacent treatment station.

The loads can be on jigs, in open-topped baskets, one of which is shown at 6 in FIG. 6, or in barrels of the type shown in FIGS. 1 and 3 of the drawings. The present invention enables the barrels to be rotated, without in any way hindering the use of the apparatus for treatment of loads supported other than in barrels.

Figure 2:
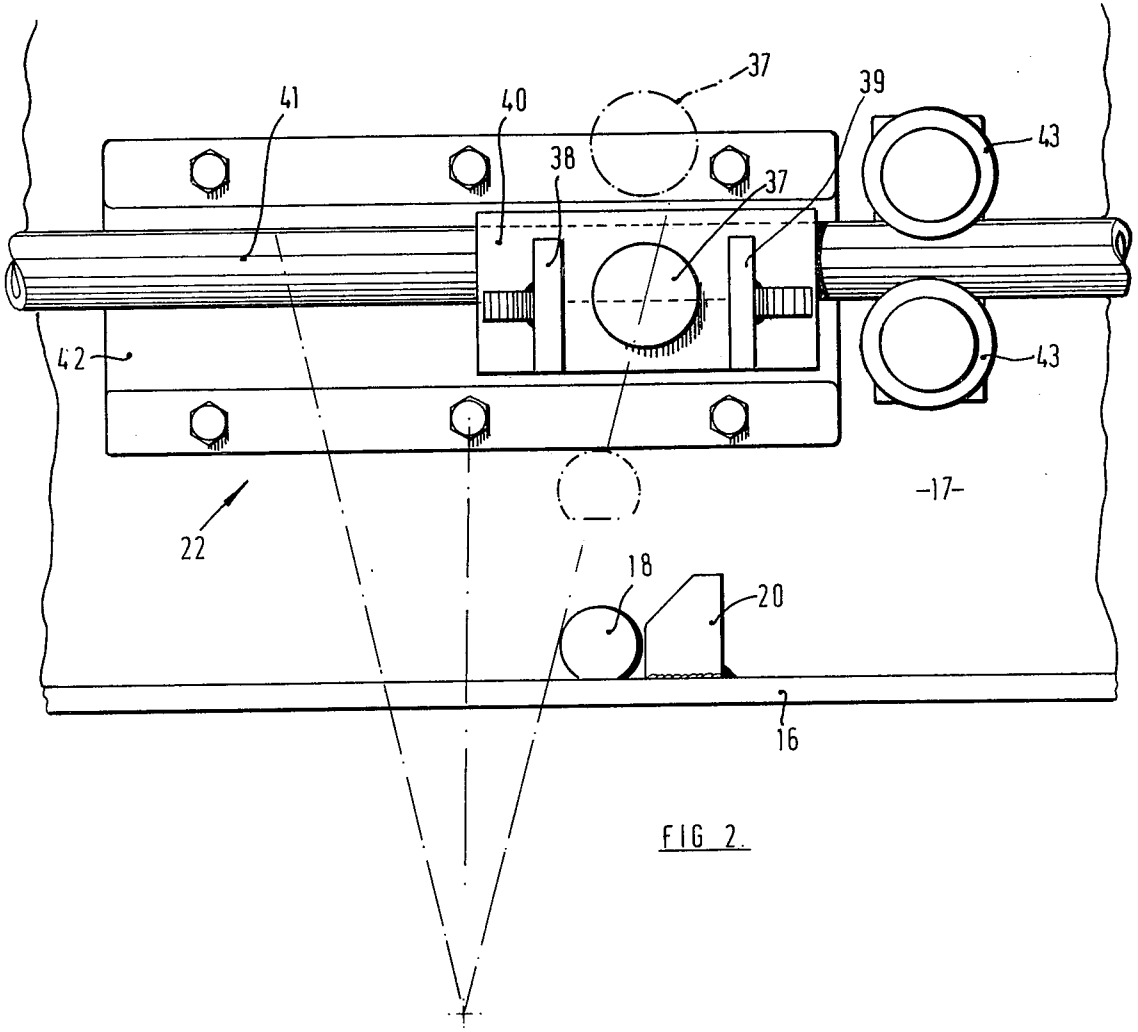
FIG. 2 is a detail side elevational view of a reciprocable barrel drive means.

This is achieved by providing a reciprocating barrel drive mechanism generally indicated at 22 in FIG. 2 of the drawings, and extending along one side wall of the main transporter beam 17. The reciprocating barrel drive operates an indexing mechanism generally indicated at 23 on the side of the barrel so that the barrel can be indexed rotationally about the axis 12.

The indexing mechanism is operated by a lever linkage generally indicated at 24 which is mounted on a bracket 25 fixed to the limb 14 of the barrel frame. The lever linkage 24 comprises a bell crank lever pivotally mounted about an axis 26 on the bracket and comprising a first arm 27 and a second, perpendicular arm 28. The arm is biased upwardly by means of a strong spring 29 which is housed within the hollow limb 14. The outer end of the second arm 28, remote from the pivotal axis 26, is attached by a link 30,31 to a bush 32 which also carries a lug 33. The lug 33 has a pivoted pawl 34 which engages a ratchet 35 fixed with respect to the barrel 10.

Also mounted on the barrel 10 is a support pawl 36 which acts in generally known manner to support the ratchet 35 against reverse movement when the pawl 34 is not in driving engagement with a tooth of the ratchet 35.

The way in which this ratchet device operates is that the upper end of the first arm 27 is rocked from side to side relative to its pivotal axis 26, thereby causing the second arm 28 of the bell crank lever to operate the links 30 and 31 and hence to rotate the ratchet 35 via the pawl 34. When the ratchet has rotated by a certain fraction of its circumference, determined by the placing of the ratchet teeth, the support pawl 36 slips over one of the teeth and prevents the ratchet from return movement when the swinging movement of the first arm 27 is reversed.

The first arm 27 is rocked by the reciprocable barrel drive 22 shown in FIG. 2. At the upper end of the first arm 27, there is provided a roller 37. For clarity in FIG. 2, the first arm is not shown.

The roller 37 is disposed between a pair of flanges 38, 39, when the reciprocable barrel drive is operating. The flanges 38 and 39 are mounted on a plate 40 which is fixed on a rod 41 extending along the entire length of the apparatus. The rod 41 is mounted on the main transporter beam 17 for reciprocation relative to the beam. The beam is provided with a low friction cushion 42 disposed at the rear of the rod, together with pairs of freely rotatable low friction support bushes 43 which guide the rod 41 for smooth longitudinal movement relative to the main beam 17.

The rod 41 is reciprocated by operating means to be described subsequently and hence it moves the flanges 38,39 back and forth from right to left as shown in FIG. 2 of the drawings. The roller 37 is therefore positively pushed back and forth from right to left, swinging the arm 27 of the bell crank lever between the limit positions shown in chain dotted lines in FIG. 2.

In a typical treatment apparatus having a plurality of stations side by side, the rod 41 may be ten or fifteen meters long and may be required to reciprocate the lever linkages of perhaps eight or ten barrels, each of which may have a substantial weight and may be loaded with even greater quantity of articles to be treated.

An operating means for the reciprocating barrel drive rod 41 therefore needs to be robust in nature. However, it also requires to be so positioned as not to obstruct the movement of barrels along the apparatus, the movement of the main transporter beam 17, or the support arrangements for articles to be treated on jigs or in open-topped baskets for example.

Figure 4:
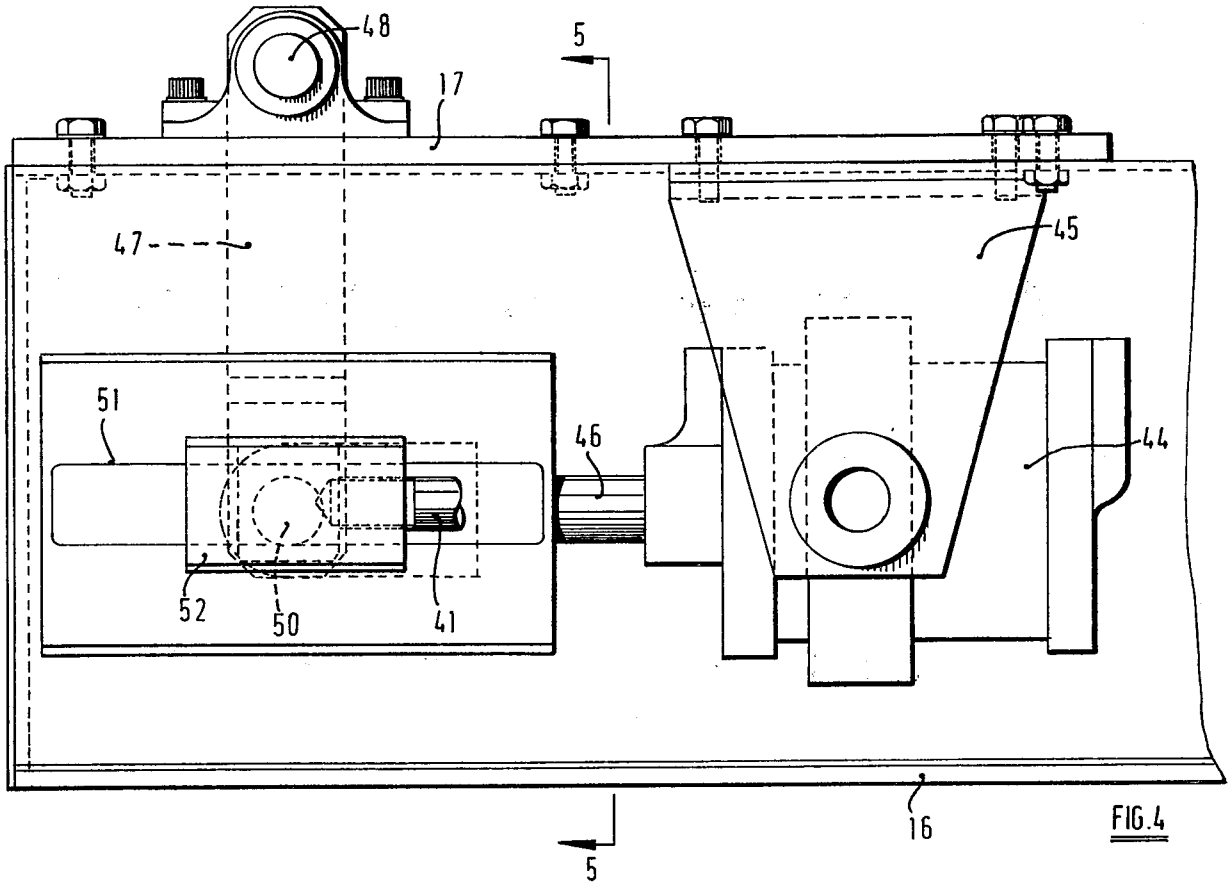
FIG. 4 is a side elevational view of an operating means for reciprocable barrel drive means of FIG. 2.
Figure 5:
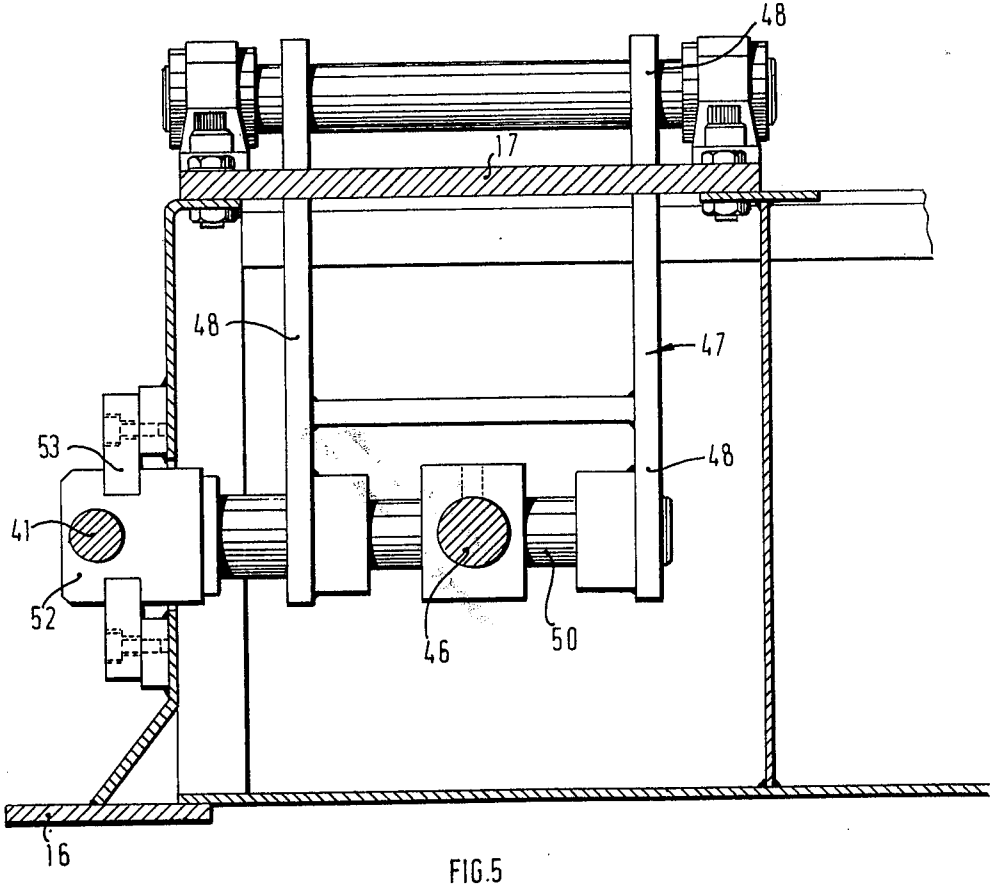
FIG. 5 is a sectional view on the line 5—5 of FIG. 4.

To satisfy these requirements in the apparatus under consideration, the operating means for the reciprocable barrel drive are disposed within the hollow main transporter beam and can be seen in FIGS. 4 and 5 of the drawings. The main transporter beam 17 is of hollow box-section, the flange 16 being visible along one lower side edge. A powerful piston and cylinder assembly 44 is disposed within the transporter beam 17, being mounted on support brackets 45 which are sufficient to take the reaction load of the piston and cylinder in use.

Since the linear movement of the piston rod 46 of the piston and cylinder cannot be transmitted directly to the rod 41 which is housed outside the transporter beam 17, a linkage, capable of withstanding a substantial turning moment, needs to be interposed between the piston rod 46 and the rod 41. The turning moment is due to the necessary lateral separation of the two rods.

The arrangement is shown in FIGS. 4 and 5 and comprises a pendulum link 47 which is pivotally mounted at 48 to rigid supports mounted on the beam 17. The pendulum link 47 is a composite structure having a pair of spaced apart limbs 48 joined by bracing 49 and by a rigid link bar 50. The link bar extends outwardly through a longitudinal window 51 in the beam 17 and is mounted in a block 52. The arrangement is such that the link bar 50 can move upwardly and downwardly relative to the block 52, which is provided with a vertical slot to receive it, but is in driving engagement considered from side to side of the block. The block is constrained for sliding movement in the window 51 which is defined in a support 53 secured to the outer face of the beam 17.

In operation, the piston and cylinder assembly is extended and contracted by regulating the supply of fluid and this causes the piston rod 46 to push or pull the pendulum link 47. The component of motion of the pendulum link which is longitudinal of the beam is transferred to the block 52 and thence to the rod 41 which is secured to the block. The vertical component of movement of the pendulum link which moves in an arcuate path about the pivot 48 is taken up by the up and down sliding movement of the link bar 50 in the block 52.

The piston and cylinder assembly can be of any suitable type and may be hydraulic or pneumatic.

It will be appreciated that control of the piston and cylinder assembly can be quite separate from the other controls of the apparatus so that the rod 41 can be driven at any position of the main transporter beam and irrespective of the position of the barrels. Indexing of the barrels will take place if the rod 41 is reciprocated when the roller 37 is disposed between the flanges 38 and 39. Thus, the barrel can be indexed at any time when it is supported on the main transporter beam, as shown in FIG. 3. However, at some stages during the machine cycle, the barrel, as referred to above, may be deposited on support brackets 21 provided at the treatment station whilst the main transporter beam moves downwardly and returns towards a preceding station. Clearly, the barrel indexing means must cease to operate during this return movement of the transporter beam. This is allowed for in the the apparatus shown because, when the main transporter beam drops from the position shown in FIG. 2, having deposited the barrel on the support brackets 21 of the treatment station, the roller 37 of the bell crank lever projects above the level of the flanges 38 and 39 as shown in chain dotted lines in FIG. 2. Furthermore, the pegs 18 on which the barrel was previously supported by the beam are now elevated above the stops 20 to enable the beam to return towards a preceding station to pick up a following barrel or other workload.

In the position shown in FIG. 3 of the drawings, the main transporter beam 17 has just returned to its starting position and is picking up a barrel 10. The flange 16 has just made contact with the pegs 18 and the feet 15 of the barrel are just about to lose contact with the support brackets 21 of the treatment station. From this position upwards, the lever linkage 24 can be operated.

It will be appreciated that, as long as the main transporter beam supports the barrel, the arm 27 can be rocked by movement of the rod 41 and hence the indexing mechanism can operate. It is immaterial whether the barrel is submerged in a liquid at the treatment station or whether it is raised slightly above the liquid. Indexing could even continue whilst the barrel was being transported from one station to another if this were desired. Thus, the barrel can be indexed whilst it is being dunked by raising and lowering the main transporter beam.

It will be appreciated that, since the rod 41 is positioned along the main transporter beam 17 above the flange 16, the mechanism in no way obstructs the use of jigs or baskets to support articles to be treated. Only when the barrel having the lever linkage 24 is introduced to the apparatus does the drive means for the indexing mechanism have any effect. The drive means can be operated completely independently of the transporter beam drive so that it can be separately programmed.

We claim:

1. A walking beam type treatment apparatus comprising a plurality of side by side treatment stations, a barrel adapted to contain workpieces, a transporter beam adapted to support the barrel and capable of movement longitudinally of the apparatus to transport the barrel from one station to another and of up and down movement to raise and lower the barrel at the treatment station, the barrel being rotatably mounted and being provided with an indexing mechanism including a pivoted lever linkage, and the beam having a longitudinally reciprocable barrel drive means adapted to bear on said lever linkage to operate the indexing mechanism when the barrel is supported by the beam.

2. Apparatus according to claim 1 wherein the reciprocable barrel drive means comprises a rod supported for reciprocating movement along the beam and provided, at one or more of the treatment stations, with an outwardly extending lug adapted to bear on the lever linkage when the barrel is supported on the beam at said treatment station.

3. Apparatus according to claim 2 wherein a further lug is provided spaced from said lug by a distance sufficient to receive the lever linkage between the lugs, whereby the lugs alternately engage the lever linkage during reciprocating movement of the rod in alternate directions.

4. Apparatus according to claim 1 wherein the indexing mechanism comprises a ratchet wheel secured rigidly to the barrel and indexed in one direction of rotation by movement of the lever linkage, and wherein pawl means are provided to hold the ratchet wheel against rearward movement after each forward indexing movement of the ratchet wheel.

5. Apparatus according to claim 1 wherein a piston and cylinder assembly drive means is provided to operate the reciprocable barrel drive.

6. Apparatus according to claim 5 wherein said piston and cylinder assembly is mounted within the transporter beam.

7. Apparatus according to claim 6 wherein the piston and cylinder assembly is operatively connected to the reciprocable barrel drive means by a linkage comprising a swinging arm mounted within the beam caused to undergo arcuate movement by reciprocating movement of the piston, the arm being linked to the reciprocable barrel drive means by coupling means capable of transmitting only a linear component of the swinging movement of said swinging arm.

8. Apparatus according to claim 7 wherein said coupling means comprise a bush mounted for horizontal sliding movement in a direction parallel to the direction of reciprocation of the barrel drive means and wherein a portion of the swinging arm is received slidably in a direction perpendicular to the direction in which the block itself reciprocates.

* * * * *